US010677235B2

(12) United States Patent
Nagura et al.

(10) Patent No.: US 10,677,235 B2
(45) Date of Patent: Jun. 9, 2020

(54) COMPRESSION DEVICE HAVING CONNECTION UNIT FOR COOLING UNIT

(71) Applicant: Kobe Steel, Ltd., Kobe-shi (JP)

(72) Inventors: Kenji Nagura, Takasago (JP); Hitoshi Takagi, Takasago (JP); Takuro Uba, Takasago (JP); Toshio Hirai, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 339 days.

(21) Appl. No.: 14/655,173

(22) PCT Filed: Feb. 4, 2014

(86) PCT No.: PCT/JP2014/000589

§ 371 (c)(1),
(2) Date: Jun. 24, 2015

(87) PCT Pub. No.: WO2014/122923

PCT Pub. Date: Aug. 14, 2014

(65) Prior Publication Data

US 2015/0354553 A1 Dec. 10, 2015

(30) Foreign Application Priority Data

Feb. 8, 2013 (JP) ..... 2013-022993

(51) Int. Cl.
*F04B 39/06* (2006.01)
*F04C 29/04* (2006.01)
(Continued)

(52) U.S. Cl.
CPC ..... *F04B 39/06* (2013.01); *F04B 5/00* (2013.01); *F04B 25/00* (2013.01); *F04C 29/04* (2013.01);
(Continued)

(58) Field of Classification Search
CPC .. F04B 39/06; F04B 5/00; F04B 25/00; F28F 7/02; F28F 3/00; F28F 2260/02; F28D 9/00; F04C 29/04; F04D 29/5826
(Continued)

(56) References Cited

U.S. PATENT DOCUMENTS 3,152,753 A 10/1964 Adams
3,312,065 A * 4/1967 Guin ..... F01K 11/04 60/669
(Continued)

FOREIGN PATENT DOCUMENTS

CN 1160535 C 8/2004
DE 1 044 343 B 11/1958
(Continued)

OTHER PUBLICATIONS

Extended European Search Report dated Sep. 19, 2016 Application No. 14749664.0.
(Continued)

*Primary Examiner* — Essama Omgba
*Assistant Examiner* — Stephen A Mick
(74) *Attorney, Agent, or Firm* — Oblon, McClelland, Maier & Neustadt, L.L.P.

(57) ABSTRACT

This compression device is provided with a reciprocating compressor which compresses a gas, and a heat exchanger which cools gas compressed by the compressor. The heat exchanger is provided with a cooling unit for cooling the gas and with a connection unit which abuts against the outside surface of the compressor and has a gas inlet passage to allow gas discharged from the compression chamber of the compressor to flow into the cooling unit.

4 Claims, 11 Drawing Sheets

(51) Int. Cl.

| | |
|---|---|
| ***F04B 25/00*** | (2006.01) |
| ***F28F 7/02*** | (2006.01) |
| ***F28F 3/00*** | (2006.01) |
| ***F28D 9/00*** | (2006.01) |
| ***F04B 5/00*** | (2006.01) |

(52) U.S. Cl.
CPC ..... *F28D 9/00* (2013.01); *F28F 3/00* (2013.01); *F28F 7/02* (2013.01); *F28F 2260/02* (2013.01)

(58) Field of Classification Search
USPC ..... 417/243
See application file for complete search history.

(56) References Cited

U.S. PATENT DOCUMENTS 3,480,201 A 11/1969 Whiting
4,334,833 A * 6/1982 Gozzi ..... F04B 9/115 417/243
5,899,669 A * 5/1999 Van Grimberge .. F04B 39/0044 417/243
6,077,053 A 6/2000 Fujikawa et al.
6,935,417 B1 8/2005 Inoue et al.
2003/0051501 A1* 3/2003 Matsushima ..... F25B 39/02 62/435
2005/0252225 A1* 11/2005 Vetter ..... B60H 1/3217 62/238.6
2006/0254307 A1* 11/2006 Shapiro ..... F04B 25/00 62/498
2009/0007592 A1* 1/2009 Higashiyama ..... F28D 1/05391 62/515
2009/0211743 A1* 8/2009 Schrader ..... F28D 1/0426 165/173

FOREIGN PATENT DOCUMENTS

JP 60-22081 A 2/1985
JP H04-31677 A 2/1992
JP H10-288158 A 10/1998
JP 2000-283668 A 10/2000
JP 2001-082328 A 3/2001

OTHER PUBLICATIONS

International Search Report and Written Opinion of the International Searching Authority dated Mar. 11, 2014, in PCT/JP2014/000589, filed Feb. 4, 2014.

* cited by examiner

COMPRESSION DEVICE HAVING CONNECTION UNIT FOR COOLING UNIT

TECHNICAL FIELD

The present invention relates to a compression device which compresses gas.

BACKGROUND ART

Recently, a hydrogen station which supplies hydrogen gas to a fuel cell-powered vehicle is proposed. In the hydrogen station, a compression device which supplies hydrogen gas in a compressed state in order to fill the fuel cell-powered vehicle with hydrogen gas efficiently is used. The compression device is provided with a compressor which compresses hydrogen gas, and a gas cooler which cools the hydrogen gas whose temperature is raised by being compressed by the compressor. As the gas cooler, for example, the use of a plate-type heat exchanger as indicated in the following Patent Document 1 is proposed.

The plate-type heat exchanger consists of a laminated body in which a number of plates are laminated. Between the laminated plates, flow passages for allowing fluid to flow therethrough are formed respectively. Then, within the heat exchanger, heat exchange between fluids flowing respectively to the flow passages next to each other in the lamination direction of the plates is conducted.

By the way, in the above compression device, a lot of pipes for connecting the compressor and the gas cooler are required. Therefore, there is a need to secure a wide installation space. Moreover, the hydrogen gas discharged from the compressor is at high pressure, so that pipes of high strength and high pressure resistance are required. Hence, the manufacturing cost of the compression device is increased. Moreover, in the above compression device, there is also a need to prevent leakage of hydrogen gas from the pipes.

CITATION LIST

Patent Document

Patent Document 1: JP 2000-283668 A

SUMMARY OF THE INVENTION

An object of the present invention is to miniaturize a compression device.

A compression device according to one aspect of the present invention is provided with a reciprocating compressor which compresses gas, and a heat exchanger which cools the gas compressed by the compressor. The heat exchanger is provided with a cooling unit which cools gas, and a connection unit which abuts on the outside surface of the compressor and has a gas inlet passage to allow the gas discharged from a compression chamber of the compressor to flow into the cooling unit.

DESCRIPTION OF EMBODIMENTS

Hereinafter, embodiments of the present invention will be described with reference to the drawings.

First Embodiment

A compression device according to a first embodiment of the present invention is a device used in a hydrogen station which supplies hydrogen to a fuel cell-powered vehicle, for example.

Figure 1:
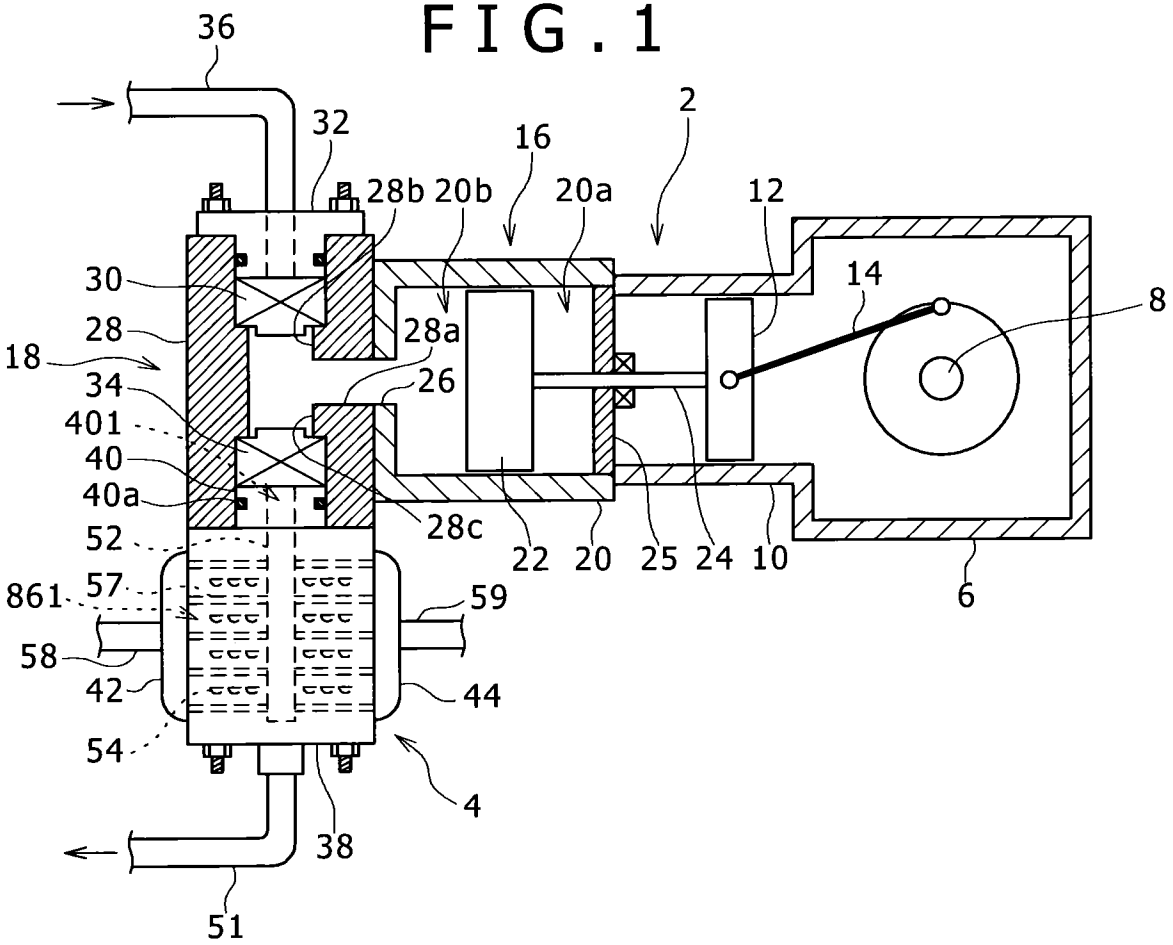
FIG. 1 is a schematic view showing a configuration of a compression device according to a first embodiment of the present invention.

As shown in FIG. 1, the compression device according to the first embodiment is provided with a compressor 2 which compresses hydrogen gas, and a gas cooler 4 which cools the hydrogen gas compressed by the compressor 2. The gas cooler 4 is a microchannel heat exchanger.

The compressor 2 is a reciprocating compressor. The compressor 2 has a crankcase 6, a crankshaft 8, a drive unit (not shown), a cross guide 10, a cross head 12, a connecting rod 14, a compression unit 16, and a supply and exhaust unit 18.

Within the crankcase 6, the crankshaft 8 is rotatably provided about a horizontal axis. The drive unit (not shown) is connected to the crankshaft 8. The drive unit transmits power to the crankshaft 8 to rotate the crankshaft 8.

The cross guide 10 is a cylindrical member continuously provided to the crankcase 6. Within the cross guide 10, the cross head 12 is accommodated so as to be able to reciprocate in the axial direction of the cross guide 10. The connecting rod 14 couples the crankshaft 8 and the cross head 12. The connecting rod 14 converts rotary motion of the crankshaft 8 to linear reciprocating motion and transmits it to the cross head 12.

The compression unit 16 is a region to compress hydrogen gas. The compression unit 16 has a tubular cylinder part 20 joined to the cross guide 10, a piston 22 accommodated in a cylinder chamber 20*a* within the cylinder part 20 so as to be able to reciprocate in the axial direction, and a piston rod 24 which couples the piston 22 and the cross head 12. Between the cylinder chamber 20*a* and the piston 22, a compression chamber 20*b* in which hydrogen gas is compressed is formed. An opening 26 is formed in the compression chamber 20*b*. A bulkhead 25 is provided between the cylinder part 20 and the cross guide 10.

The supply and exhaust unit 18 is a region to supply hydrogen gas to the compression chamber 20*b* and exhaust from the compression chamber 20*b*. The supply and exhaust unit 18 has a supply and exhaust unit housing 28, a suction valve 30, a suction-side flange 32, and a discharge valve 34.

The supply and exhaust unit housing 28 is joined to the cylinder part 20. The supply and exhaust unit housing 28 has a communication passage 28*a* which communicates with the opening 26 of the cylinder part 20, a suction passage 28*b*, and a discharge passage 28*c*. The suction passage 28*b* and the discharge passage 28*c* extend in the vertical direction. The communication passage 28*a* and the opening 26 link the compression chamber 20*b* to the suction passage 28*b* and the discharge passage 28*c*.

Within the suction passage 28*b*, the suction valve 30 being a check valve is installed. In an opening part of the suction passage 28*b*, the suction-side flange 32 is inserted and fixed. To the suction-side flange 32, a supply pipe 36 for supplying hydrogen gas is connected. Within the discharge passage 28*c*, the discharge valve 34 being a check valve is installed. It should be noted that in the compression device, electromagnetic valves or the like may be used as the suction valve and the discharge valve.

The gas cooler 4 has a body part 38, an inlet joint 40, a supply header 42, and a recovery header 44.

Figure 2:
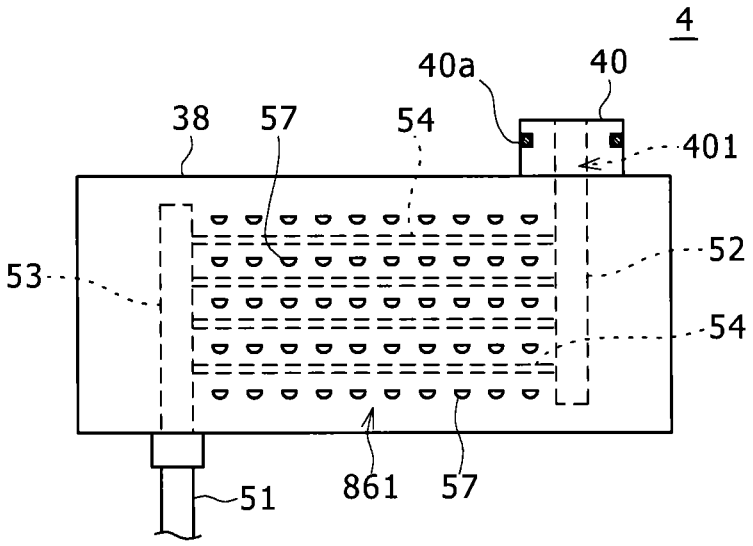
FIG. 2 is a view of a body part and an inlet joint of a gas cooler constituting the compression device of FIG. 1 viewed from the side.
Figure 4:
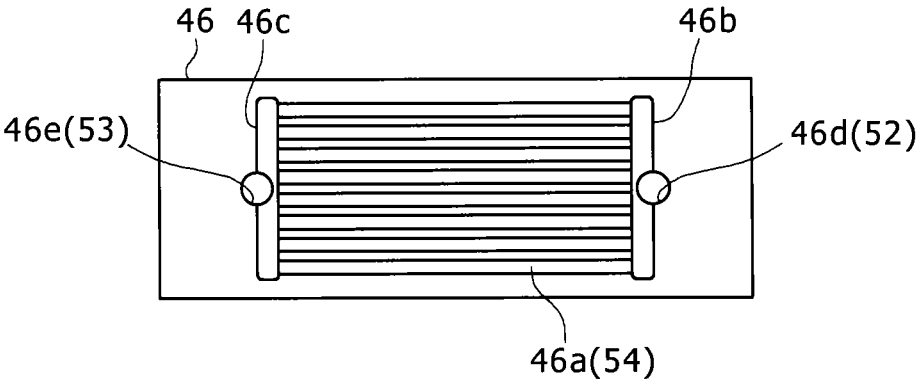
FIG. 4 is a plan view of a hydrogen gas plate constituting the gas cooler of the first embodiment.
Figure 5:
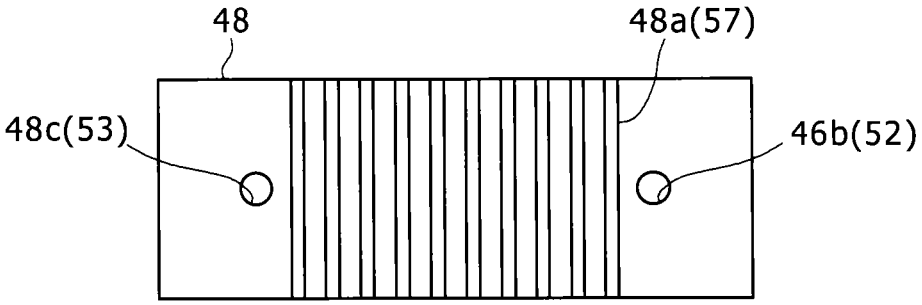
FIG. 5 is a plan view of a cooling water plate constituting the gas cooler of the first embodiment.

FIG. 2 is a view of the body part 38 and the inlet joint 40 of FIG. 1 viewed from the side. The body part 38 has a rectangular parallelepiped outer shape. The body part 38 is a laminated body in which an end plate 50 shown in FIG. 3, a hydrogen gas plate 46 shown in FIG. 4, and a cooling water plate 48 shown in FIG. 5 are laminated.

The hydrogen gas plate 46 is a rectangular flat plate formed of stainless steel. The hydrogen gas plate 46 is provided with an inlet passage through-hole 46*d*, an exhaust passage through-hole 46*e*, and a plurality of hydrogen gas flow passage groove parts 46*a* formed on one surface.

The cooling water plate 48 is a rectangular flat plate formed of stainless steel as with the hydrogen gas plate 46. The cooling water plate 48 is provided with an inlet passage through-hole 48*b*, an exhaust passage through-hole 48*c*, and a plurality of cooling water flow passage groove parts 48*a* formed on one plate surface. In the end plate 50, a through-hole 50*b* is formed.

Figure 3:
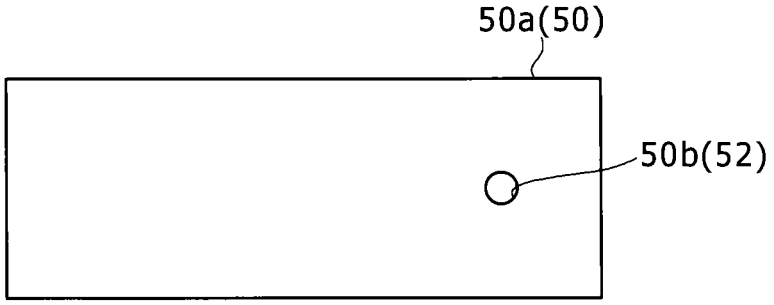
FIG. 3 is a plan view of an end plate constituting the gas cooler of the first embodiment.

The body part 38 is a laminated body formed by alternately laminating a plurality of cooling water plates 48 and a plurality of hydrogen gas plates 46 between a pair of end plates 50. However, the end plate 50 of the lower part of the body part 38 is disposed in a state that FIG. 3 is inverted right and left. The plates 46, 48 and 50 constituting the body part 38 are formed integrally by diffusion bonding. As shown in FIG. 2, in the body part 38, a plurality of micro flow passages 54 are formed. The plurality of micro flow passages 54 are formed by the plurality of hydrogen gas flow passage groove parts 46*a* shown in FIG. 4. As shown in FIG. 2, in the body part 38, a plurality of cooling water flow passages 57 are formed. The plurality of cooling water flow passages 57 are formed by the plurality of cooling water flow passage groove parts 48*a* shown in FIG. 5. Hereinafter, in the body part 38, a region where the micro flow passages 54 and the cooling water flow passages 57 are formed is referred to as "a cooling unit 861".

In the body part 38, a gas inlet passage 52 (see FIG. 2) extending in the lamination direction of the plates is formed by linking the through-hole 50*b* of the upper-side end plate 50 shown in FIG. 3, the inlet passage through-hole 48*b* (see FIG. 5) of the plurality of cooling water plates 48, and the inlet passage through-hole 46*d* (see FIG. 4) of the plurality of hydrogen gas plates 46. By linking the through-hole 50*b* of the lower-side end plate 50, the exhaust passage through-hole 48*c* of the plurality of cooling water plates 48, and the exhaust passage through-hole 46*e* of the plurality of hydrogen gas plates 46, a gas exhaust passage 53 extending in the lamination direction of the plates is formed.

In FIG. 1, of the right and left side surfaces of the body part 38 to which the cooling water flow passage 57 opens, the supply header 42 is attached to the left side surface. To the supply header 42, a cooling water supply pipe 58 is connected. To the right side surface of the body part 38 to which the cooling water flow passage 57 opens, the recovery header 44 is attached. To the recovery header 44, a cooling water recovery pipe 59 is connected. In the gas cooler 4, cooling water flows from the cooling water supply pipe 58 to the cooling water recovery pipe 59 via the supply header 42, the cooling water flow passage 57 and the recovery header 44.

As shown in FIG. 2, the inlet joint 40 is joined to the upper part of the body part 38. Within the inlet joint 40, an inlet passage 401 to allow hydrogen gas to flow into is formed. As shown in FIG. 1, in the compression device, the body part 38 vertically abuts on the outside surface of the supply and exhaust unit housing 28 in a state that the inlet joint 40 is inserted into the discharge passage 28*c* of the supply and exhaust unit housing 28. That is, a laminated body abuts on the outside surface of the compressor. Thereby, the inlet passage 401 and the discharge passage 28*c* are communicated. Around the inlet joint 40, a seal 40*a* for preventing leakage of hydrogen gas is provided. In the gas cooler 4, the inlet joint 40 being an insertion part, and a region forming the gas inlet passage 52, play a role as a connection unit which connects the compression chamber 20*b* of the compressor 2 with the cooling unit 861. Hereinafter, the inlet passage 401 will be described as a part of the gas inlet passage 52. With the above configuration, hydrogen gas can be allowed to flow into the gas cooler 4 from the compressor 2 without passing through pipes.

At the time of driving the compression device, hydrogen gas is supplied to the compression chamber 20*b* from the supply pipe 36 via the suction valve 30, and the piston 22 contracts the compression chamber 20*b*, thereby hydrogen gas is compressed. The pressure of hydrogen gas becomes about 82 MPa, and the temperature thereof becomes about 150° C. The compressed hydrogen gas flows into the cooling unit 861 via the gas inlet passage 52 of the gas cooler 4 from the discharge valve 34.

In the cooling unit 861, hydrogen gas exchanges heat with the cooling water flowing through the cooling water flow passage 57 in the middle of flowing through the micro flow passage 54 and thereby is cooled. The cooled hydrogen gas is exhausted from the exhaust pipe 51.

Hereinbefore, while the compression device according to the first embodiment has been described, in the compression device according to the first embodiment, pipes between the compressor 2 and the gas cooler 4 can be omitted because the gas cooler 4 is fixed directly to the compressor 2. As a result, the installation space of pipes is not required, and the compression device can be miniaturized. Moreover, the number of pipes can be reduced, so that the manufacturing cost of the compression device can be reduced. Further, pipe joint spots that need to check leakage of hydrogen gas, can be reduced.

In the compression device, by utilizing the microchannel heat exchanger as the gas cooler 4, hydrogen gas can be efficiently cooled while securing strength. The inlet joint 40 is inserted into the discharge passage 28*c* of the compressor 2 and fixed thereto, so that the gas cooler 4 can be fixed to the compressor 2 more firmly. In the gas cooler 4, the inlet joint 40 can be formed of a member different from the body part 38. Therefore, even if the gas cooler 4 is combined with the other compressor, by producing the inlet joint 40 so as to match the shape of the discharge passage of the other compressor, the gas cooler 4 can be easily attached to the other compressor 2. Thus, design freedom of the compression device can be improved. It should be noted that if the body part 38 and the supply and exhaust unit housing 28 are substantially abutted, a resin material used for sealing may be interposed between the body part 38 and the supply and exhaust unit housing 28. The same applies to the following other embodiments.

Second Embodiment

Figure 6:
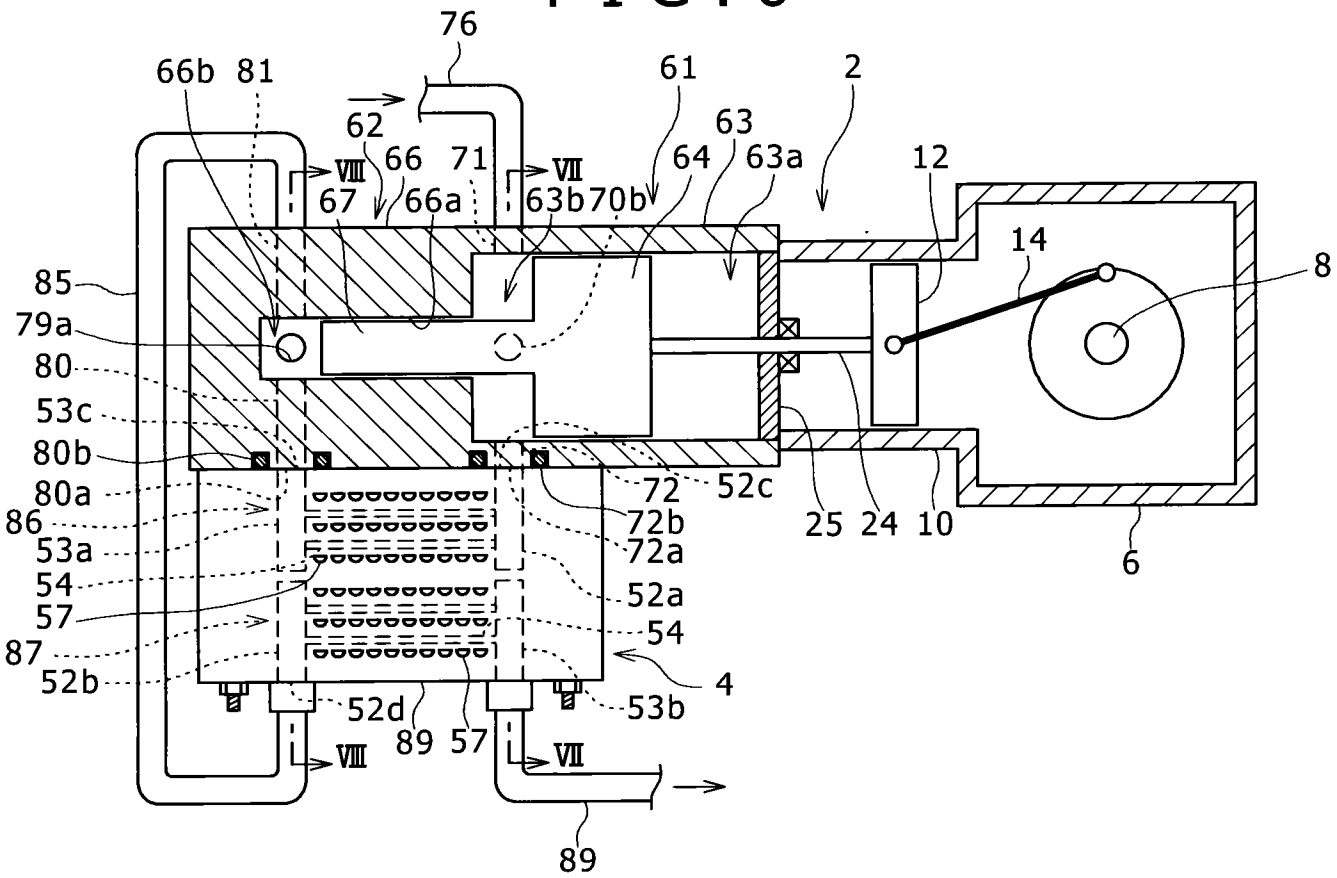
FIG. 6 is a schematic view of a compression device according to a second embodiment of the present invention showing a state that a recovery header is removed.

FIG. 6 is a view showing a compression device according to a second embodiment of the present invention. The compression device is provided with a two-stage compression type compressor 2, and a gas cooler 4 which cools the hydrogen gas compressed at the first stage by the compressor 2 and the hydrogen gas compressed at the second stage respectively. Moreover, the compression device is provided with a crankcase 6, a crankshaft 8, a drive unit (not shown), a cross guide 10, a cross head 12, and a connecting rod 14 similar to the above first embodiment. Hereinafter, the configuration of the compression device according to the second embodiment will be described concretely with reference to FIG. 6 to FIG. 11.

As shown in FIG. 6, the compressor 2 has a first compression unit 61 which compresses hydrogen gas at the first stage, and a second compression unit 62 which compresses hydrogen gas at the second stage.

The first compression unit 61 has a first cylinder part 63 and a first piston 64. The second compression unit 62 has a second cylinder part 66 formed integrally with the first cylinder part 63, and a second piston 67 formed integrally with the first piston 64.

The first cylinder part 63 is joined to the cross guide 10. In the first cylinder part 63, a first cylinder chamber 63*a* which accommodates the first piston 64 so as to be able to reciprocate is formed. In the second cylinder part 66, a second cylinder chamber 66*a* which accommodates the second piston 67 so as to be able to reciprocate is formed. The first cylinder chamber 63*a* and the second cylinder chamber 66*a* are both spaces of circular cross section. The second cylinder chamber 66*a* has a smaller diameter than the first cylinder chamber 63*a*. To the end on the cross guide 10 side of the first piston 64, a piston rod 24 linked to the cross head 12 is attached. The second piston 67 extends to the opposite side of the piston rod 24 from the first piston 64. The first piston 64 and the second piston 67 are both formed into a columnar shape. The second piston 67 has a smaller diameter than the first piston 64.

Between the first cylinder chamber 63*a* and the first piston 64, a first compression chamber 63*b* in which hydrogen gas is compressed is formed. Between the second cylinder chamber 66*a* and the second piston 67, a second compression chamber 66*b* in which the hydrogen gas compressed in the first compression chamber 63*b* is further compressed is formed.

Figure 7:
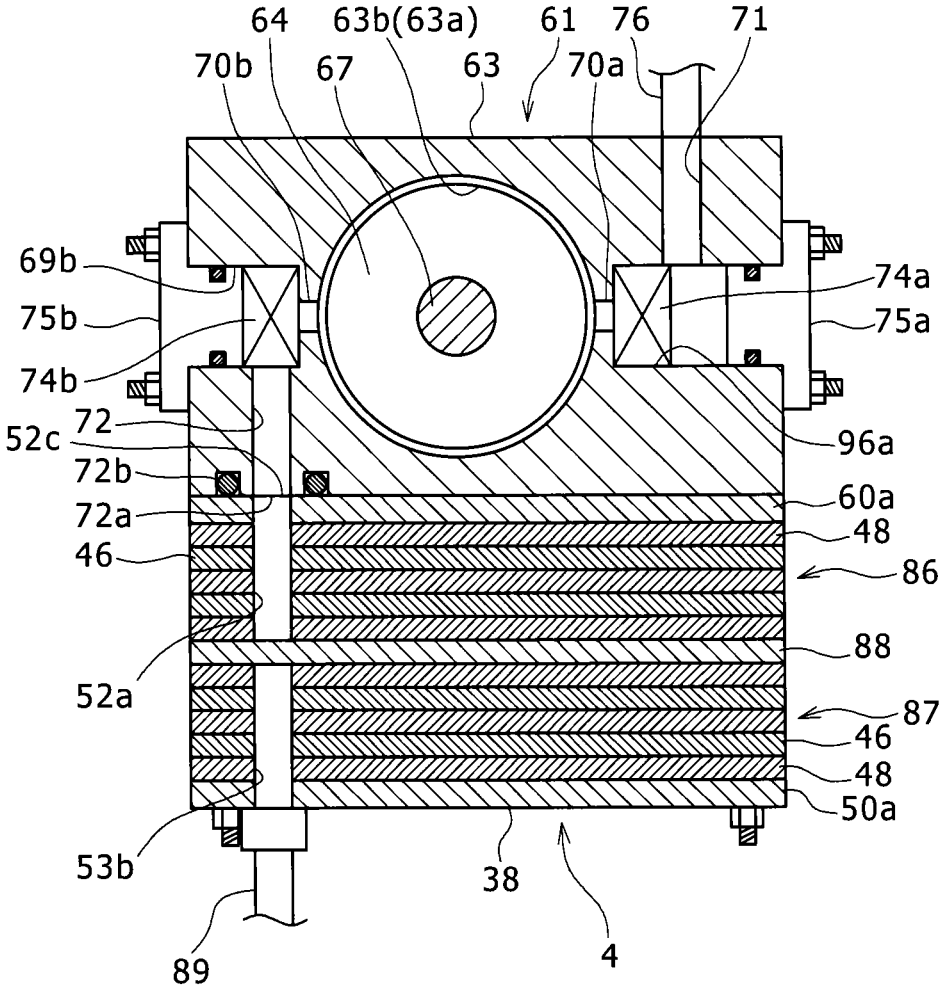
FIG. 7 is a cross-sectional view of the compression device according to the second embodiment cut at a position of the arrow VII-VII in FIG. 6.

FIG. 7 is a cross-sectional view of the compression device cut at a position of the arrow VII-VII in FIG. 6, The first cylinder part 63 is provided with a first suction valve accommodating chamber 96*a*, a first suction-side communication passage 70*a*, a first suction passage 71, a first discharge valve accommodating chamber 69*b*, a first discharge-side communication passage 70*b*, and a first discharge passage 72. The first suction valve accommodating chamber 96*a* and the first discharge valve accommodating chamber 69*b* are located on either side of the first compression chamber 63*b*. The first suction valve accommodating chamber 96*a* and the first discharge valve accommodating chamber 69*b* extend in a direction perpendicular to the moving direction of the first and the second pistons 64, 67 respectively within a horizontal plane. Hereinafter, the moving direction of the first and the second pistons 64, 67 is referred to as merely "the moving direction".

In the first suction valve accommodating chamber 96*a*, a first suction valve 74*a* is accommodated. The first suction valve 74*a* is fixed by a first suction valve fixing flange 75*a*. The first suction-side communication passage 70*a* communicates the first compression chamber 63*b* and the first suction valve accommodating chamber 96*a*. In the first discharge valve accommodating chamber 69*b*, a first discharge valve 74*b* is accommodated. The first discharge valve 74*b* is fixed by a first discharge valve fixing flange 75*b*. The first discharge-side communication passage 70*b* communicates the first compression chamber 63*b* and the first discharge valve accommodating chamber 69*b*.

The first suction passage 71 is disposed on the upper side of the first suction valve accommodating chamber 96*a*. The first suction passage 71 extends downward from the upper surface of the first cylinder part 63 and is linked to the first suction valve accommodating chamber 96*a*. To the upper end of the first suction passage 71, a supply pipe 76 for supplying hydrogen gas from a supply source (not shown) is connected. The first discharge passage 72 extends from the first discharge valve accommodating chamber 69*b* to the lower surface of the first cylinder part 63. The first discharge passage 72 has a first discharge passage opening 72*a* which opens on the lower surface of the first cylinder part 63. In the lower surface of the first cylinder part 63, a circular groove surrounding the first discharge passage opening 72*a* is formed. In the circular groove around the first discharge passage opening 72*a*, a seal 72*b* is fitted.

Figure 8:
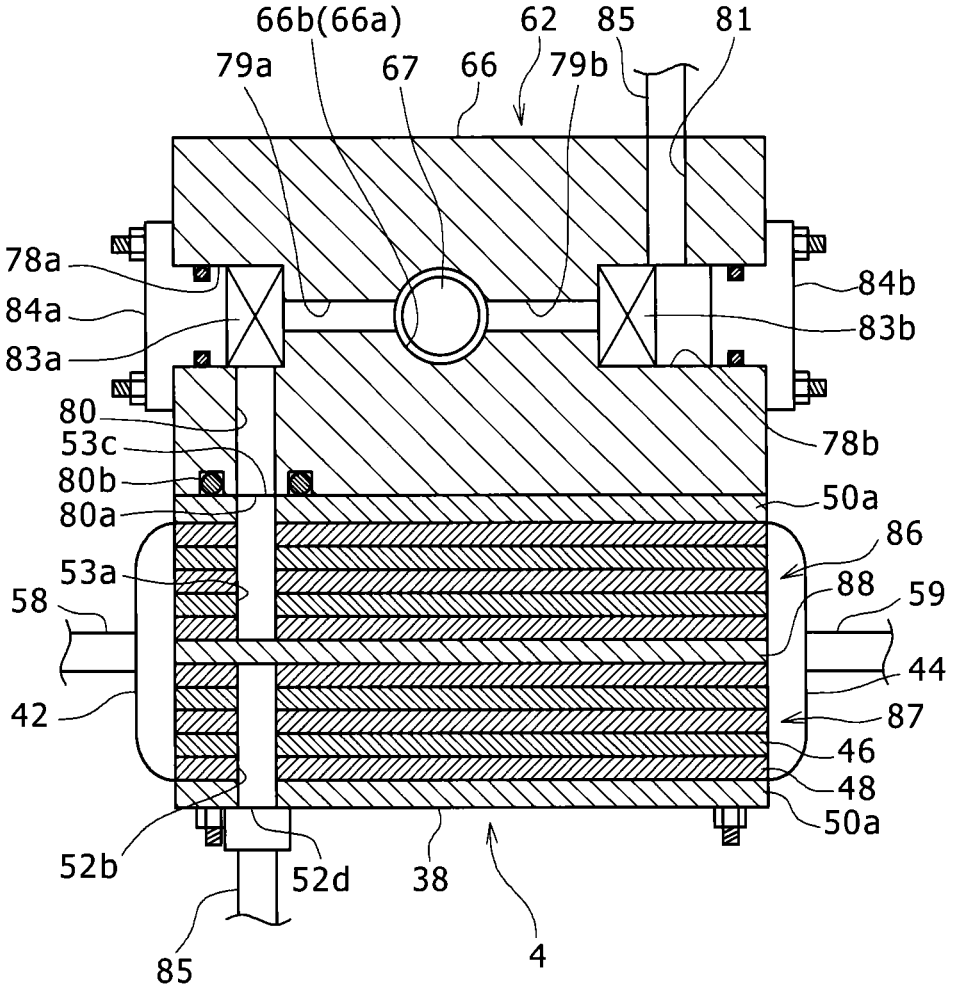
FIG. 8 is a cross-sectional view of the compression device according to the second embodiment cut at a position of the arrow VIII-VIII in FIG. 6.

FIG. 8 is a cross-sectional view of the compression device cut at a position of the arrow VIII-VIII in FIG. 6. The second cylinder part 66 is provided with a second suction valve accommodating chamber 78*a*, a second suction-side communication passage 79*a*, a second suction passage 80, a second discharge valve accommodating chamber 78*b*, a second discharge-side communication passage 79*b*, and a second discharge passage 81. The second suction valve accommodating chamber 78*a* and the second discharge valve accommodating chamber 78*b* are located on either side of the second compression chamber 66*b*. The second suction valve accommodating chamber 78*a* and the second discharge valve accommodating chamber 78*b* extend in a direction perpendicular to the moving direction respectively within a horizontal plane. In the second suction valve accommodating chamber 78*a*, a second suction valve 83*a* is accommodated. The second suction valve 83*a* is fixed by a second suction valve fixing flange 84*a*. The second suction-side communication passage 79*a* communicates the second compression chamber 66*b* and the second suction valve accommodating chamber 78*a*. In the second discharge valve accommodating chamber 78*b*, a second discharge valve 83*b* is accommodated. The second discharge valve 83*b* is fixed by a second discharge valve fixing flange 84*b*. The second discharge-side communication passage 79*b* is a passage for communicating the second compression chamber 66*b* and the second discharge valve accommodating chamber 78*b*.

The second suction passage 80 is disposed on the lower side of the second valve accommodating chamber 78. The second suction passage 80 extends upward from the lower surface of the second cylinder part 66 and is linked to the second valve accommodating chamber 78. The second suction passage 80 has a second suction passage opening 80*a* which opens on the lower surface of the second cylinder part 66. The lower surface of the second cylinder part 66 and the lower surface of the first cylinder part 63 are flush and are formed in a plane. In the lower surface of the second cylinder part 66, a circular groove surrounding the second suction passage opening 80*a* is formed. In the circular groove around the second suction passage opening 80*a*, a seal 80*b* is fitted. The second discharge passage 81 is disposed on the upper side of the second discharge valve accommodating chamber 78*b*. The second discharge passage 81 extends downward from the upper surface of the second cylinder part 66. To the upper end of the second discharge passage 81, a communication pipe 85 is connected.

As shown in FIG. 6 to FIG. 8, the body part 38 of the gas cooler 4 has a first cooling unit 86 which cools the hydrogen gas compressed at the first stage, and a second cooling unit 87 which cools the hydrogen gas compressed at the second stage. The first cooling unit 86 is disposed on one side (the upper side) in the lamination direction of the plates in the body part 38, and the second cooling unit 87 is disposed on the other side (the lower side) in the lamination direction of the plates in the body part 38.

Figure 9:
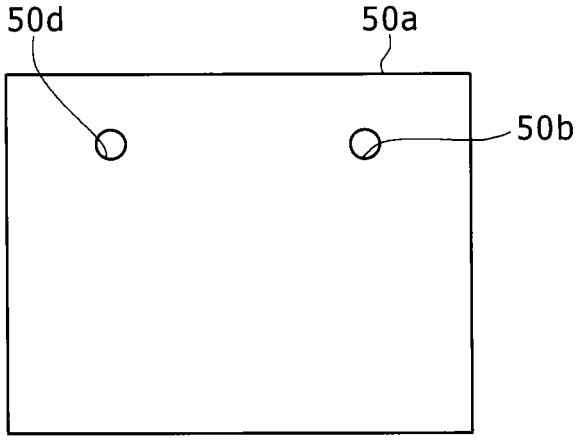
FIG. 9 is a plan view of an end plate constituting a gas cooler of the second embodiment.
Figure 10:
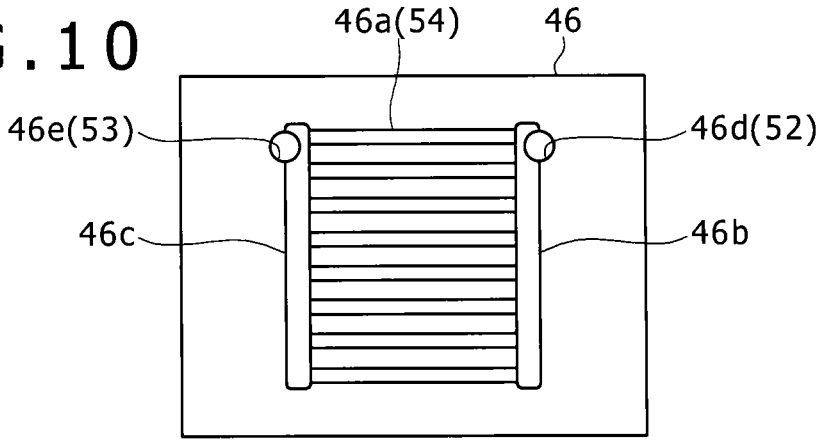
FIG. 10 is a plan view of a hydrogen gas plate constituting the gas cooler of the second embodiment.
Figure 11:
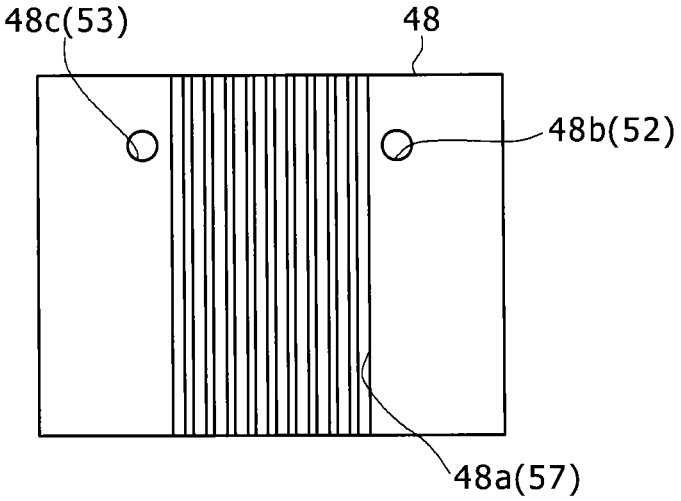
FIG. 11 is a plan view of a cooling water plate constituting the gas cooler of the second embodiment.

FIG. 9 is a view showing an end plate 50*a*. FIG. 10 is a view showing a hydrogen gas plate 46. FIG. 11 is a view showing a cooling water plate 48. The body part 38 is provided with a pair of end plates 50*a*, a plurality of hydrogen gas plates 46, a plurality of cooling water plates 48, and a partition plate 88 shown in FIG. 7 and FIG. 8. As shown in FIG. 9, the end plate 50*a* is provided with an inlet passage through-hole 50*b* and an exhaust passage through-hole 50*d*. As shown in FIG. 10, the hydrogen gas plate 46 is provided with a plurality of hydrogen gas flow passage groove parts 46*a*, a distribution unit groove part 46*b*, a recovery unit groove part 46*c*, an inlet passage through-hole 46*d* linked to the distribution unit groove part 46*b*, and an exhaust passage through-hole 46*e* linked to the recovery unit groove part 46*c*. As shown in FIG. 11, the cooling water plate 48 is provided with a plurality of cooling water flow passage groove parts 48*a*, an inlet passage through-hole 48*b*, and an exhaust passage through-hole 48*c*.

In the gas cooler 4, the first cooling unit 86 shown in FIG. 6 to FIG. 8 is formed by alternately and repeatedly laminating the cooling water plates 48 and the hydrogen gas plates 46 between the end plate 50*a* disposed on the upper side and the partition plate 88. By communicating the inlet passage through-holes 46*d*, 48*b*, and 50*b*, a first gas inlet passage 52*a* is formed. By communicating the exhaust passage through-holes 46*e*, 48*c*, and 50*d*, a first gas exhaust passage 53*a* is formed.

Moreover, the second cooling unit 87 is formed by alternately and repeatedly laminating the cooling water plates 48 and the hydrogen gas plates 46 between the end plate 50*a* disposed on the lower side and the partition plate 88. However, in the second cooling unit 87, the positional relationship between the distribution unit groove part 46*b* and the recovery unit groove part 46*c* and the positional relationship between the inlet passage through-hole 46*d* and the exhaust passage through-hole 46*e* in the hydrogen gas plate 46, are opposite to the case of the hydrogen gas plate 46 of the first cooling unit 86 respectively. Moreover, in the second cooling unit 87, the positional relationship between the inlet passage through-hole 48*b* and the exhaust passage through-hole 48*c* in the cooling water plate 48 is opposite to the case of the first cooling unit 86. Moreover, the positional relationship between the inlet passage through-hole 50*b* and the exhaust passage through-hole 50*d* in the end plate 50*a* is opposite to the case of the first cooling unit 86.

By communicating the inlet passage through-holes 46*d*, 48*b*, and 50*b*, the second gas inlet passage 52*b* shown in FIG. 6 is formed. By communicating the exhaust passage through-holes 46*e*, 48*c*, and 50*d*, the second gas exhaust passage 53*b* is formed.

The upper surface of the body part 38 vertically abuts on the outside surfaces of the first and the second cylinder parts 63, 66. The first discharge passage opening 72*a* formed in the lower side of the first compression chamber 63*b* and the opening 52*c* of the first gas inlet passage 52*a* of the gas cooler 4 vertically overlap. The second suction passage opening 80*a* formed in the lower side of the second compression chamber 66*b* and the opening 53*c* of the first gas exhaust passage 53*a* of the gas cooler 4 vertically overlap. In addition, around the first discharge passage opening 72*a*, a seal 72*b* for preventing leakage of hydrogen gas is provided. Around the second suction passage opening 80*a*, a seal 80*b* for preventing leakage of hydrogen gas is provided.

At the time of driving the compression device, hydrogen gas is sucked into the first compression chamber 63*b* via the first suction valve 74*a* (see FIG. 7), and hydrogen gas is compressed by the first piston 64. The hydrogen gas compressed in the first compression chamber 63*b* flows into the first cooling unit 86 via the first gas inlet passage 52*a* of the gas cooler 4 from the first discharge valve 74*b* (see FIG. 7) and the first discharge passage 72.

Hydrogen gas flows to a micro flow passage 54 formed by the hydrogen gas flow passage groove part 46*a* (see FIG. 10), and is cooled by heat exchange with the cooling water flowing through a cooling water flow passage 57 formed by the cooling water flow passage groove part 48*a* (see FIG. 11).

The cooled hydrogen gas is exhausted to the second compression chamber 66*b* from the first cooling unit 86 via the first gas exhaust passage 53*a*. In the second compression chamber 66*b*, hydrogen gas is further compressed by the second piston 67. The hydrogen gas compressed in the second compression chamber 66*b* is discharged to the communication pipe 85 through the second discharge passage 81. The hydrogen gas discharged to the communication pipe 85 flows into the second gas inlet passage 52*b* of the second cooling unit 87. The hydrogen gas flowed into the second gas inlet passage 52*b* flows to the second exhaust passage 53*b* and exhausted to an exhaust pipe 89 after being cooled in the second cooling unit 87.

As discussed above, in the gas cooler 4, a region forming the first gas inlet passage 52*a* plays a role as a connection unit which connects the first compression chamber 63*b* of the compressor 2 with the first cooling unit 86, and a region forming the first gas exhaust passage 53*a* plays a role as a connection unit which connects the second compression chamber 66*b* of the compressor 2 with the first cooling unit 86.

Also in the second embodiment, the gas cooler 4 is fixed directly to the compressor 2, thereby capable of miniaturizing the compression device. Moreover, the manufacturing cost of the compression device can be reduced by reducing the number of components. Also pipe joint spots that need to check leakage of hydrogen gas, can be also reduced. In the second embodiment, cooling of the hydrogen gas discharged from the first and the second compression chambers 63*b*, 66*b* is conducted in one gas cooler 4, so that the compression device can be further miniaturized.

Third Embodiment

Next, with reference to FIG. 12 to FIG. 15, a compression device according to a third embodiment of the present invention will be described.

Figure 12:
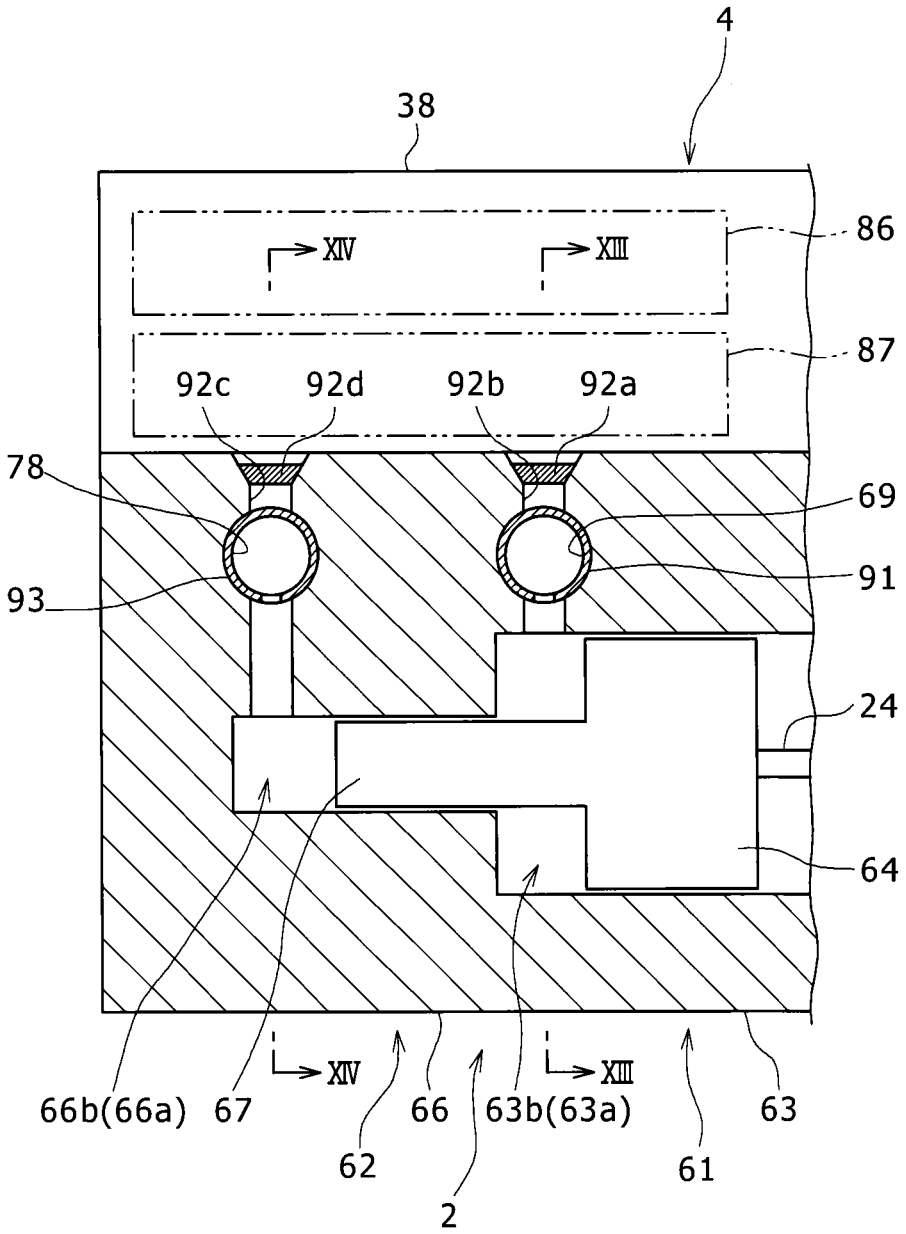
FIG. 12 is a schematic view partially showing a configuration of a compression device according to a third embodiment of the present invention.

As shown in FIG. 12, a compressor 2 is provided with a first compression chamber 63*b* and a second compression chamber 66*b*. A gas cooler 4 is disposed on the upper side of the compressor 2. The gas cooler 4 is provided with a first cooling unit 86 which cools the hydrogen gas compressed in the first compression chamber 63*b*, and the second cooling unit 87 which cools the hydrogen gas compressed in the second compression chamber 66*b*. The first cooling unit 86 and the second cooling unit 87 are arranged so as to align vertically.

Figure 13:
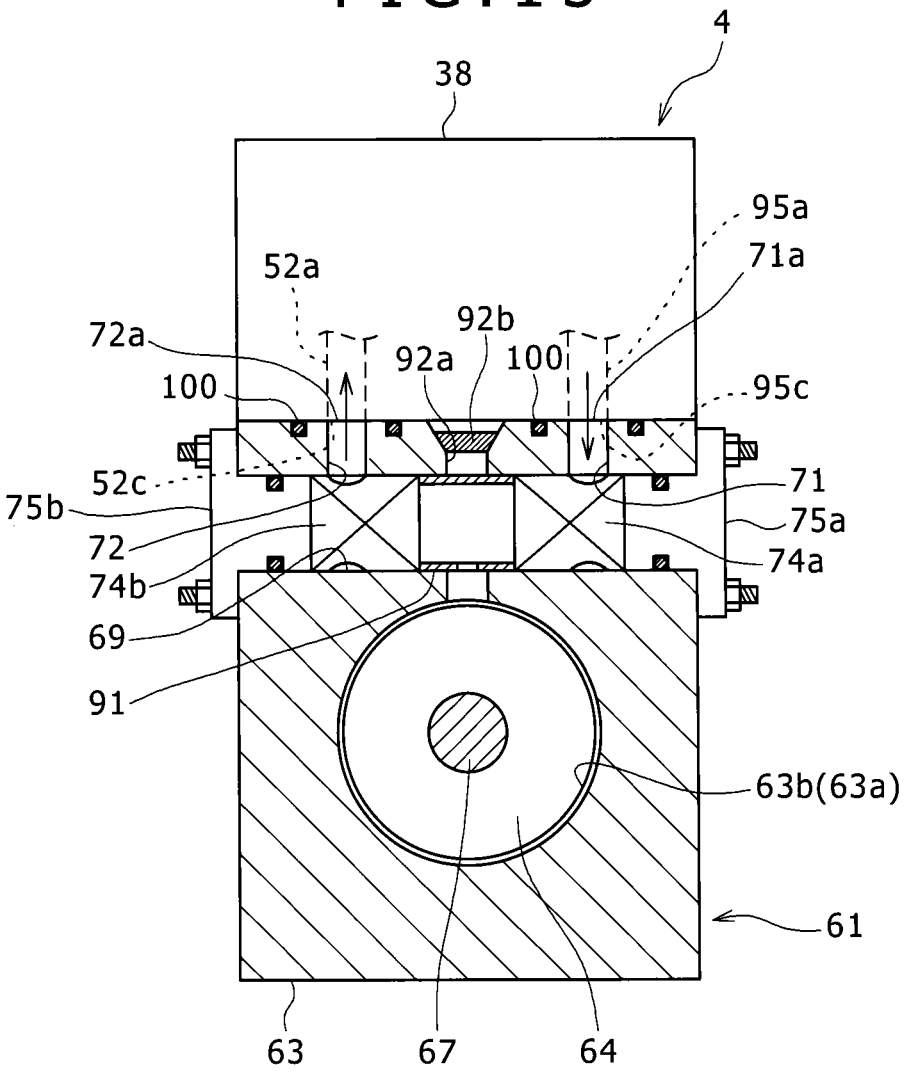
FIG. 13 is a cross-sectional view of a compressor according to the third embodiment cut at a position of the arrow XIII-XIII in FIG. 12, and the view also showing an appearance of a gas cooler.

FIG. 13 is a cross-sectional view of the compressor 2 cut at a position of the arrow XIII in FIG. 12. FIG. 13 shows also an appearance of the gas cooler 4. Between the first compression chamber 63*b* and the gas cooler 4, a first valve accommodating chamber 69 is formed. The first valve accommodating chamber 69 extends in a direction perpendicular to the above moving direction within a horizontal plane. Within the first valve accommodating chamber 69, a first suction valve 74*a* and a first discharge valve 74*b* are accommodated in a state that a cylindrical first spacer 91 is sandwiched therebetween. The first suction valve 74*a*, the first discharge valve 74*b*, and the first spacer 91 are fixed by first valve fixing flanges 75*a*, 75*b*. A first suction passage 71 is formed between the first suction valve 74*a* and the gas cooler 4. A first discharge passage 72 is formed between the first discharge valve 74*b* and the gas cooler 4. In addition, a residual hole 92*a* formed in the upper side of the first spacer 91 is blocked up by a plug 92*b*.

Figure 14:
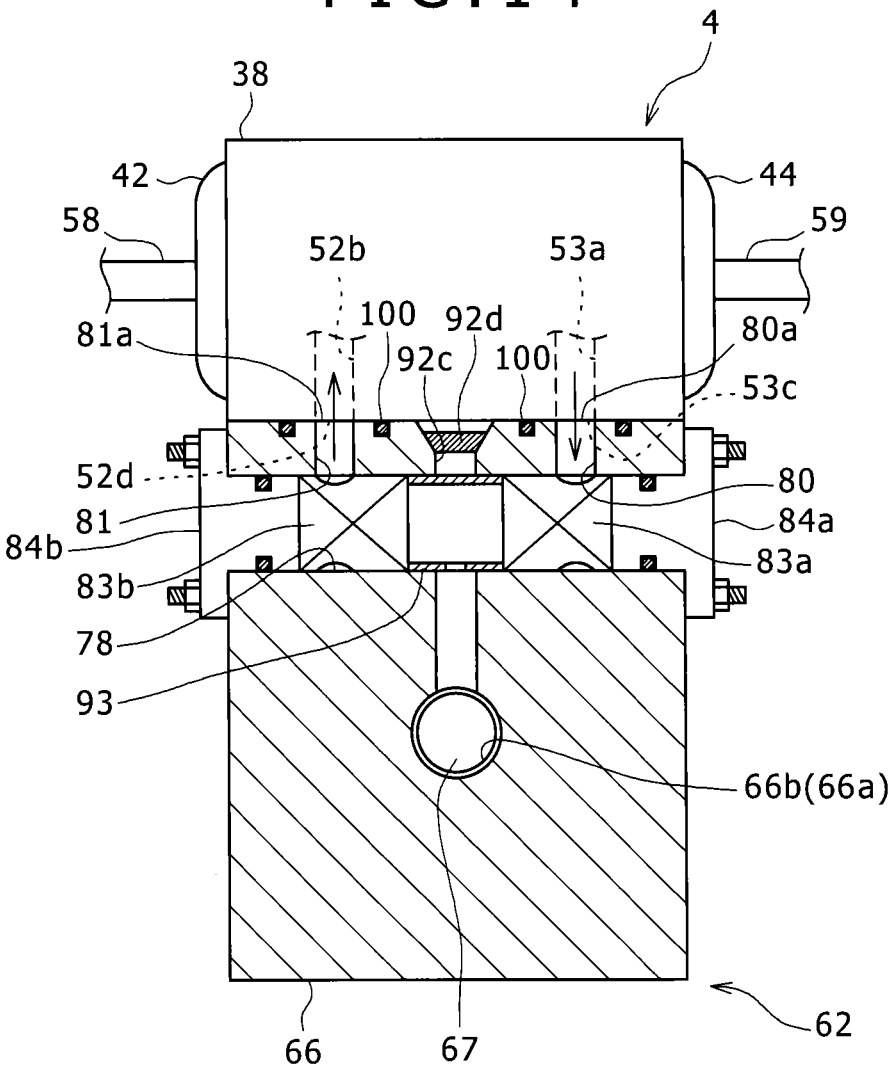
FIG. 14 is a cross-sectional view of the compressor according to the third embodiment cut at a position of the arrow XIV-XIV in FIG. 12, and the view also showing the appearance of the gas cooler.

FIG. 14 is a cross-sectional view of the compressor 2 cut at a position of the arrow XIV in FIG. 12. FIG. 14 shows also an appearance of the gas cooler 4. Between the second compression chamber 66*b* and the gas cooler 4, a second valve accommodating chamber 78 is formed. The second valve accommodating chamber 78 has a structure similar to the first valve accommodating chamber 69, and extends in a direction perpendicular to the above moving direction within a horizontal plane. Within the second valve accommodating chamber 78, a second suction valve 83*a* and a second discharge valve 83*b* are accommodated in a state that a cylindrical second spacer 93 is sandwiched therebetween. The second suction valve 83*a*, the second discharge valve 83*b*, and the second spacer 93 are fixed by second valve fixing flanges 84*a*, 84*b*. A second suction passage 80 is formed between the second suction valve 83*a* and the gas cooler 4. A second discharge passage 81 is formed between the second discharge valve 83*b* and the gas cooler 4. In addition, a residual hole 92*c* provided in the second valve accommodating chamber 78 is blocked up by a plug 92*d*.

Figure 15:
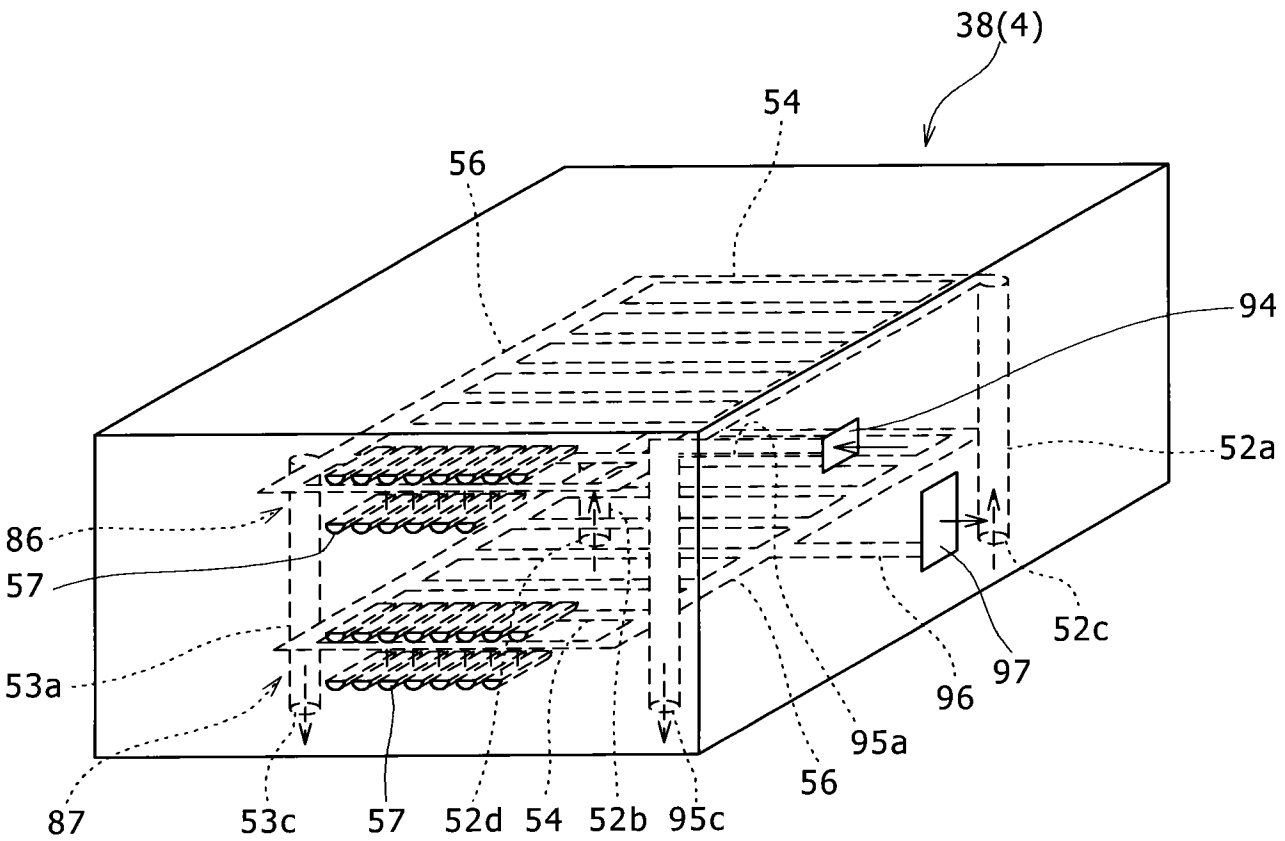
FIG. 15 is a perspective view showing an internal structure of the gas cooler of the compression device according to the third embodiment.

FIG. 15 is a view showing an internal structure of the gas cooler 4. The gas cooler 4 is provided with the first cooling unit 86, the second cooling unit 87, an introduction port 94, an exhaust port 97, a gas introduction passage 95*a*, a first gas inlet passage 52*a*, a first gas exhaust passage 53*a*, a second gas inlet passage 52*b*, and a gas derivation passage 96. In addition, in FIG. 15, some flow passages among all flow passages are illustrated for the sake of simplicity. However, actually, as with the above second embodiment, in the first cooling unit 86 and the second cooling unit 87, the layers on which a plurality of micro flow passages 54 are arranged and the layers on which a plurality of cooling water flow passages 57 are arranged are alternately aligned and disposed in the vertical direction of FIG. 15, that is, the lamination direction of the plates.

In one side surface of the body part 38 of the gas cooler 4, the introduction port 94 and the exhaust port 97 for hydrogen gas are formed. The gas introduction passage 95*a* extends below the body part 38 from the introduction port 94, and opens to the lower surface of the body part 38. Hereinafter, an opening of the gas introduction passage 95*a* is referred to as "an introduction passage opening 95*c*". The first gas inlet passage 52*a* extends to the first cooling unit 86 from the lower surface of the body part 38. Hereinafter, an opening of the first gas inlet passage 52*a* in the lower surface of the body part 38 is referred to as "a first inlet passage opening 52*c*". The first gas exhaust passage 53*a* extends downward from a recovery unit 56 of the first cooling unit 86, and opens to the lower surface of the body part 38. Hereinafter, an opening of the first gas exhaust passage 53*a* is referred to as "a first exhaust passage opening 53*c*".

The second gas inlet passage 52*b* extends to the second cooling unit 87 from the lower surface of the body part 38. Hereinafter, an opening of the second gas inlet passage 52*b* in the lower surface of the body part 38 is referred to as "a second inlet passage opening 52*d*". The gas derivation passage 96 extends to the exhaust port 97 from the recovery unit 56 of the second cooling unit 87.

As shown in FIG. 13, in a state that the gas cooler 4 and the compressor 2 are abutted vertically, the introduction passage opening 95*c* overlaps vertically with an opening 71*a* of the first suction passage 71 of the compressor 2. The first inlet passage opening 52*c* overlaps vertically with an opening 72*a* of the first discharge passage 72. As shown in FIG. 14, the first exhaust passage opening 53*c* overlaps vertically with an opening 80*a* of the second suction passage 80. The second inlet passage opening 52*d* overlaps vertically with an opening 81*a* of the second discharge passage 81. In addition, around the introduction passage opening 95*c*, the first inlet passage opening 52*c*, the first exhaust passage opening 53*c*, and the second inlet passage opening 52*d*, seals 100 are provided respectively.

At the time of driving the compression device, the hydrogen gas introduced from the introduction port 94 of the gas cooler 4 shown in FIG. 15 flows to the first compression chamber 63*b* shown in FIG. 13 through the gas introduction passage 95*a*. Hydrogen gas is compressed in the first compression chamber 63*b*. The hydrogen gas discharged from the first compression chamber 63*b* flows into the first cooling unit 86 via the first gas inlet passage 52*a*, and is cooled in the first cooling unit 86. The cooled hydrogen gas is exhausted to the second compression chamber 66*b* shown in FIG. 14 from the first cooling unit 86 via the first gas exhaust passage 53*a*. Hydrogen gas flows into the second cooling unit 87 from the second compression chamber 66*b* via the second gas inlet passage 52*b* after being further compressed in the second compression chamber 66*b*. The hydrogen gas cooled in the second cooling unit 87 passes through the gas derivation passage 96 and is exhausted from the exhaust port 97.

Thus, in the gas cooler 4, a region forming the first gas inlet passage 52*a*, a region forming the first gas exhaust passage 53*a*, and a region forming the second gas inlet passage 52*b* play a role as a connection unit which connects the compression chambers 63*b*, 66*b* of the compressor 2 with the cooling units 86, 87.

Also in the third embodiment, the compression device can be miniaturized as with the other embodiments. The manufacturing cost of the compression device also can be reduced. In the compression device, the first cooling unit 86 may be disposed on the lower side of the second cooling unit 87. Moreover, the first cooling unit 86 may be provided on the upper side of the first compression chamber 63*b*, and the second cooling unit 87 may be provided on the upper side of the second compression chamber 66*b*. The compression device may have a vertically inverted structure of the above-mentioned structure of the compressor 2 and the gas cooler 4.

In addition, it should be considered that the embodiments disclosed herein are exemplary and not restrictive in all respects. The scope of the present invention is expressed by not the above described embodiments but claims, and includes the meaning equivalent to claims and all modifications within the scope.

For example, as the heat exchanger, heat exchangers other than the microchannel heat exchanger may be used. For example, as the heat exchanger, various plate-type heat exchangers such as a plate-fin type heat exchanger may be used. The plat-fin type heat exchanger has a structure different from the microchannel heat exchanger in the way of processing of the groove shape and the way of bonding the laminated layers but similar to the microchannel heat exchanger in function. Moreover, tube-type heat exchangers may be used as the heat exchanger.

In the second embodiment, a composite valve may be used instead of the first suction valve 74*a* and the first discharge valve 74*b* shown in FIG. 7. The composite valve is a valve having both functions of the suction valve and the discharge valve. In this case, the first suction passage 71 and the first discharge passage 72 are one linked flow passage, and the composite valve is disposed in a region which links the flow passage and the first compression chamber 63*b*. Similarly, the second suction passage 80 and the first discharge passage 81 are one linked flow passage, and the composite valve may be disposed in a region which links the flow passage and the second compression chamber 66*b*.

In the second embodiment and the third embodiment described above, by closely contacting the end surface of the cylinder part of the compressor and the end surface of the heat exchanger body of the gas cooler, the flow passages of the compressor and the flow passages of the heat exchanger body are directly connected. This configuration may be applied to a compression device using a single-stage compression type compressor. Moreover, the above configuration may be applied to a compression device in which the cross guide and the cylinder part are vertically joined in such a manner that the moving direction of the piston becomes the vertical direction, and in which the gas cooler is attached to the side surface of the cylinder part.

The hydrogen gas flow passage may be formed in a meandering shape on the plate surface of the hydrogen gas plate, and the cooling water flow passage may be formed in a meandering shape on the plate surface of the cooling water plate. According to this configuration, the surface area of the hydrogen gas flow passage and the cooling water flow passage can be increased, and hydrogen gas can be more effectively cooled. The compression device of the above embodiments may be used for compression of gas such as helium gas or natural gas lighter than air other than hydrogen gas, and may be used for compression of gas such as carbon dioxide. The technique for directly connecting the gas cooler to the compressor may be applied to a compression device having three-stage or more compression unit.

SUMMARY OF EMBODIMENTS

The above embodiments will be summarized as follows.

A compression device according to the above embodiments is provided with a reciprocating compressor which compresses gas, and a heat exchanger which cools the gas compressed by the compressor. The heat exchanger is provided with a cooling unit which cools gas, and a connection unit which abuts on the outside surface of the compressor and has a gas inlet passage to allow the gas discharged from a compression chamber of the compressor to flow into the cooling unit.

In this compression device, the compressor and the heat exchanger are connected without passing through pipes, so that the manufacturing cost can be reduced. The installation space of pipes is not required, and the compression device can be miniaturized. Moreover, the fear of gas leakage between the compressor and the heat exchanger can be reduced.

In the above compression device, the compressor may be provided with the other compression chamber in which the gas compressed in the compression chamber is further compressed. The connection unit may further have a gas exhaust passage which exhausts gas to the other compression chamber from the cooling unit.

In this case, the heat exchanger may be further provided with the other cooling unit which cools the gas discharged from the other compression chamber. The connection unit may further have the other gas inlet passage to allow gas to flow into the other cooling unit from the other compression chamber.

Further in this case, the compressor may be provided with a first valve accommodating chamber disposed between the compression chamber and the heat exchanger, and a second valve accommodating chamber disposed between the other compression chamber and the heat exchanger. The first valve accommodating chamber may accommodate a first suction valve which leads gas to the compression chamber, and a first discharge valve which discharges gas to the cooling unit via the gas inlet passage from the compression chamber. The second valve accommodating chamber may accommodate a second suction valve which leads the gas exhausted from the cooling unit, to the other compression chamber via the gas exhaust passage, and a second discharge valve which discharges gas to the other cooling unit via the other gas inlet passage from the other compression chamber.

In the compression device, the heat exchanger may be a laminated body in which the layers on which a plurality of micro flow passages to allow the gas flowed into from the compressor to flow therethrough are arranged, and the layers on which a plurality of cooling water flow passages to allow cooling water for cooling the gas to flow therethrough are arranged, are alternately laminated.

According to this configuration, good cooling efficiency of gas can be obtained. The heat exchanger can be easily attached to the compressor.

In the above compression device, the connection unit may be provided with an insertion part to be inserted in the gas flow passage within the compressor.

According to this configuration, the compressor and the heat exchanger can be firmly fixed to each other.

As discussed above, according to the above embodiments, the compression device can be miniaturized.

The invention claimed is:

1. A compression device, comprising:

a reciprocating compressor which compresses gas, and a heat exchanger which cools the gas, wherein the heat exchanger comprises:

a first cooling unit which cools the compressed gas, wherein the heat exchanger is a laminated body in which layers on which a plurality of micro flow passages allow the gas flowed into the heat exchanger from the compressor to flow therethrough are arranged, and layers on which a plurality of cooling fluid flow passages to allow cooling fluid for cooling the gas to flow therethrough are arranged, are alternately laminated, and a connection unit which includes said laminated body and which abuts on the outside surface of the compressor such that the laminated body abuts on the outside surface of the compressor, the connection unit having a first gas inlet passage to allow the gas discharged from a first compression chamber of the compressor to flow into the first cooling unit, wherein the compressor further comprises a second compression chamber in which the gas compressed in the first compression chamber is further compressed, the connection unit further has a gas exhaust passage which exhausts gas to the second compression chamber from the first cooling unit, the heat exchanger further comprises a second cooling unit which cools the gas discharged from the second compression chamber, and the connection unit further has a second gas inlet passage to allow gas to flow into the second cooling unit from the second compression chamber.

2. The compression device according to claim 1, wherein the compressor comprises:

a first valve accommodating chamber disposed between the first compression chamber and the heat exchanger; and a second valve accommodating chamber disposed between the second compression chamber and the heat exchanger, the first valve accommodating chamber accommodates a first suction valve which leads gas to the first compression chamber, and a first discharge valve which discharges gas to the first cooling unit via the first gas inlet passage from the first compression chamber, and the second valve accommodating chamber accommodates a second suction valve which leads the gas exhausted from the first cooling unit, to the second compression chamber via the gas exhaust passage, and a second discharge valve which discharges gas to the second cooling unit via the second gas inlet passage from the second compression chamber.

3. The compression device according to claim 1, wherein the connection unit further comprises an insertion part defining an inlet passage for the heat exchanger inserted into a gas flow passage within the compressor, and a seal providing fluid tightness for the insertion part with respect to the gas flow passage within the compressor.

4. The compression device according to claim 1, wherein the second cooling unit abuts the first cooling unit such that the first cooling unit is sandwiched between the compressor and the second cooling unit.

* * * * *